United States Patent [19]

Brekle

[11] 3,976,815

[45] Aug. 24, 1976

[54] METHOD FOR CLEANING AND COATING ROD

[75] Inventor: Oliver R. Brekle, Pell City, Ala.

[73] Assignee: M & B Metal Products Company, Leeds, Ala.

[22] Filed: Apr. 30, 1975

[21] Appl. No.: 573,356

Related U.S. Application Data

[63] Continuation of Ser. No. 315,201, Dec. 14, 1975, Pat. No. 3,886,894.

[52] U.S. Cl. ..... 427/292; 427/327; 427/348; 427/52; 427/424; 118/72; 118/325; 118/63; 51/90; 51/DIG. 10; 72/46; 72/40

[51] Int. Cl.[2] ..... B21C 43/04

[58] Field of Search ..... 118/6, 144, 620, 63; 51/DIG. 10; 451/327, 348, 52; 106/74; 252/135; 427/290, 292

[56] References Cited

UNITED STATES PATENTS

| | | | |
|---|---|---|---|
| 643,041 | 2/1900 | Coddington | 118/DIG. 22 |
| 2,105,637 | 1/1938 | Davis | 51/DIG. 10 |
| 2,196,662 | 4/1940 | Hakansson | 51/DIG. 10 |
| 2,913,354 | 11/1959 | Bell | 118/72 X |
| 3,533,761 | 10/1970 | Pierson | 118/63 X |
| 3,641,970 | 2/1972 | Brekle | 118/72 |
| 3,886,894 | 6/1975 | Brekle | 118/44 |

FOREIGN PATENTS OR APPLICATIONS

| | | |
|---|---|---|
| 2,127,366 | 11/1972 | France |

*Primary Examiner*—Ralph S. Kendall
*Attorney, Agent, or Firm*—Robert T. Tobin

[57] ABSTRACT

An apparatus and method for continuously cleaning and coating wire is disclosed in which rod having scale and other inpurities on its outer surface is first mechanically descaled by passage through a plurality of spatially positioned rollers, then cleaned by frictional scraping by at least two rotating and orbiting abrasive drums which scrape the entire outer surface of the rod. The cleaned rod is then covered by a coating solution and electrically heated to a temperature sufficient to bake a coating on the exterior surface of the rod. The rod is then passed to a drawing apparatus.

4 Claims, 12 Drawing Figures

14
13
10
12
9
42
11

74
77
N
78
15
16
38
41
39
40
44
46
54
B
43
A
45
48
64
53
65
47
63
70
75
66
49
55
10
69
50
51
68
67

METHOD FOR CLEANING AND COATING ROD

This is a continuation of application Ser. No. 315,201 filed Dec. 14, 1975, now U.S. Pat. No. 3,886,894.

BACKGROUND OF THE INVENTION

1. Field of the Invention

The present invention relates to an method for cleaning and coating rod. More particularly, it relates to an method for descaling, cleaning and coating rod, prior to the drawing of the rod.

2. Description of the Prior Art

In the production of wire from a raw material such as steel rod (also commonly called "wire") the rod is passed through a plurality of drawing dies, each of which reduce the cross sectional area of the rod. As received from the mill, the raw rod has "scale" on its outer surface. This scale is comprised of impurities such as primary and secondary metal oxides and other brittle substances. Prior to passing the rod through the drawing process, this "scale" must be removed because if the raw rod is fed directly into the dies, the scale acts as an abrasive and clogs and destroys the dies. Thus, a need exists for processes which will remove the scale and prepare the rod for drawing.

Further, because the rod is drawn by pulling the wire through a restricted opening thereby developing high frictional heat, it is desirable to lubricate the surface of the rod in order to permit the smooth passage of the rod through the drawing dies. To accomplish this, it is desirable to coat the cleaned surface of the rod with a dry coating of borax or lime which acts as a carrier for the lubricant used in the drawing process.

A prior method for removing the scale on the outer surface of the rod, was to "pickle" the rod, that is soak the rod in an acid bath. This method presents extensive problems not only in the handling of the material, but also in the neutralizing and disposal of the spent acid. Moreover, in recent years, mainly because of ecological restrictions, acid pickling is being prohibited at more and more locations.

Other suggested methods employ a variety of mechanical descalers such as cascading steel balls and tapered abrasive bars which are used as cleaning or abrading devices for the rod. Examples of these devices are shown in U.S. Pat. Nos. 2,975,506 and 2,703,550. While the apparatus of these two prior patents is an improvement over the conventional pickling system, they both lack the effectiveness, compactness, continuity and reliability of the new improved apparatus and method of this invention. Thus, a need exists for a convenient, continuous process and apparatus for processing raw rod to produce an acceptable product for direct feeding to drawing benches.

An example of an apparatus for carrying out a continuous process for descaling, cleaning and coating of rod with a borax or lime solution prior to drawing, is shown in my basic U.S. Pat. No. 3,641,970, issued Feb. 15, 1972, entitled "Apparatus For Preparing Wire For Drawing," of which this application comprises an improvement.

It is therefore an object of this invention to provide a continuous process for cleaning and coating rod to produce cleaned rod having a coating of lime or other suitable substance baked thereon.

Another object of this invention is to provide a compact, self-contained apparatus which treats raw metal rod, descales it, cleans it, applies a coating of lime or borax solution thereto and electrically heats the rod to lessen the thermal shock to the rod as it is drawn through the die.

SUMMARY OF THE INVENTION

To achieve the objects of my invention, an method are provided to continuously descale, clean, coat and deliver rod to a drawing bench where the rod is pulled through the drawing bench by the drawing apparatus. A control system is provided to stop the apparatus of this invention and the drawing bench should a break or snarl occur in the rod. As a first step the rod is pulled by the drawing apparatus and fed through a feeding control mechanism which is adapted to detect breaks or snarls. It then passes through a plurality of descaling rollers. The partially descaled rod, after passing over the descaling rollers, is then passed through a cleaning unit, comprised of two rotating resilient means, each of which has an abrasive outer surface. The resilient means are designed not only to rotate in opposition to each other at the point of contact with the rod and thereby tangentially scrape the longitudinal surface of the rod, but also to orbit about the advancing rod and thus scrape the entire outer surface of the rod. After passing through the cleaning unit, mens are provided to continuously coat the rod with a lime or borax solution and to heat the coated rod to a temperature sufficient to bake the lime or borax on to the cleaned, descaled surface of the rod. The heating of the rod is accomplished by using the rod as an electrical conductor as it passes over two revolving sheaves. Use is thereby made of electrical resistance heating of the rod to evaporate the liquid and bake a coating of lime or borax on to the rod. The cleaned rod, with an exterior coating of baked lime or borax, is then passed through a suitable lubricant and into the drawing dies of the drawing bench.

An optional variation may be to apply a combined lubricant and borax or lime solution to the cleaned, descaled rod and bake this solution as a coating on the outer surface of the rod.

In order to control the apparatus, unique feeding or pay-off and control systems are used in which means responsive to the occurrence of snags or breaks in the rod cause a shut down of the electrical power to the system, the entire apparatus and the drawing mechanism. This is accomplished by employing a pneumatic cylinder which responds to a snag and triggers an air valve, diverting air to an air switch, thereby stopping all power and all movement in the apparatus. Additional safety switches are employed to insure that opening of access doors or a break in the wire will result in stopping all electrical power to the system.

BRIEF DESCRIPTION OF THE DRAWINGS

The objects and features of my present invention will become apparent to those skilled in the art from the following detailed description of a preferred embodiment of the apparatus and method for practicing my invention. This description, however, is to be considered in conjunction with the drawings in which.

DESCRIPTION OF THE PREFERRED EMBODIMENT

Figure 1:
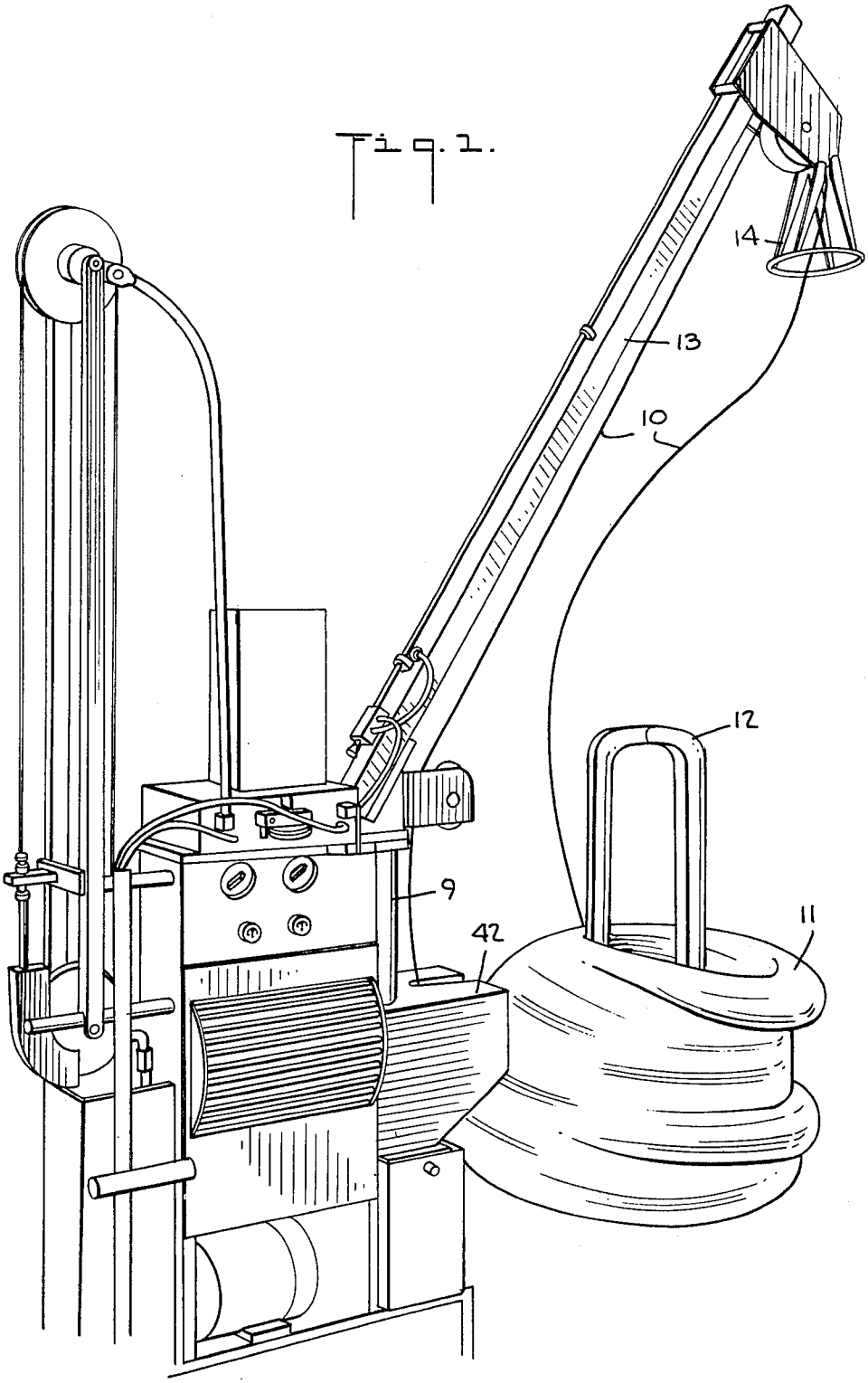
FIG. 1 illustrates an overall perspective view of the machine embodying my invention.

As shown in FIG. 1, the rod 10 is received from the mill in a coil 11 which is placed on a stanchion 12. In order to feed the rod to the machine, rod 10 is unwound up through the feeding boom or pay-off device 13. Boom 13 is pivotable about rod 9 in order to permit its movement from stanchion 12 to another stanchion for the supply of additional rod when the coils on one stanchion are depleted. Boom 13 also has a feed guide 14 adapted to prevent snagging of the rod as the rod is unwound from coil 11.

The rod 10, unwound from coil 11, passes through guide 14, over pulley 15, down parallel to boom 13 and over pulley 16. Optionally, pulley 16 may operate a centrifugal control switch mounted within pulley 16 and connected to the control of the power supply of the machine. Thus when the rod breaks or stops, causing pulley 16 to stop rotating, the switch rotated by pulley 16 opens, and disconnects the control the power supply to the entire unit, thereby shutting it down.

Figure 3:
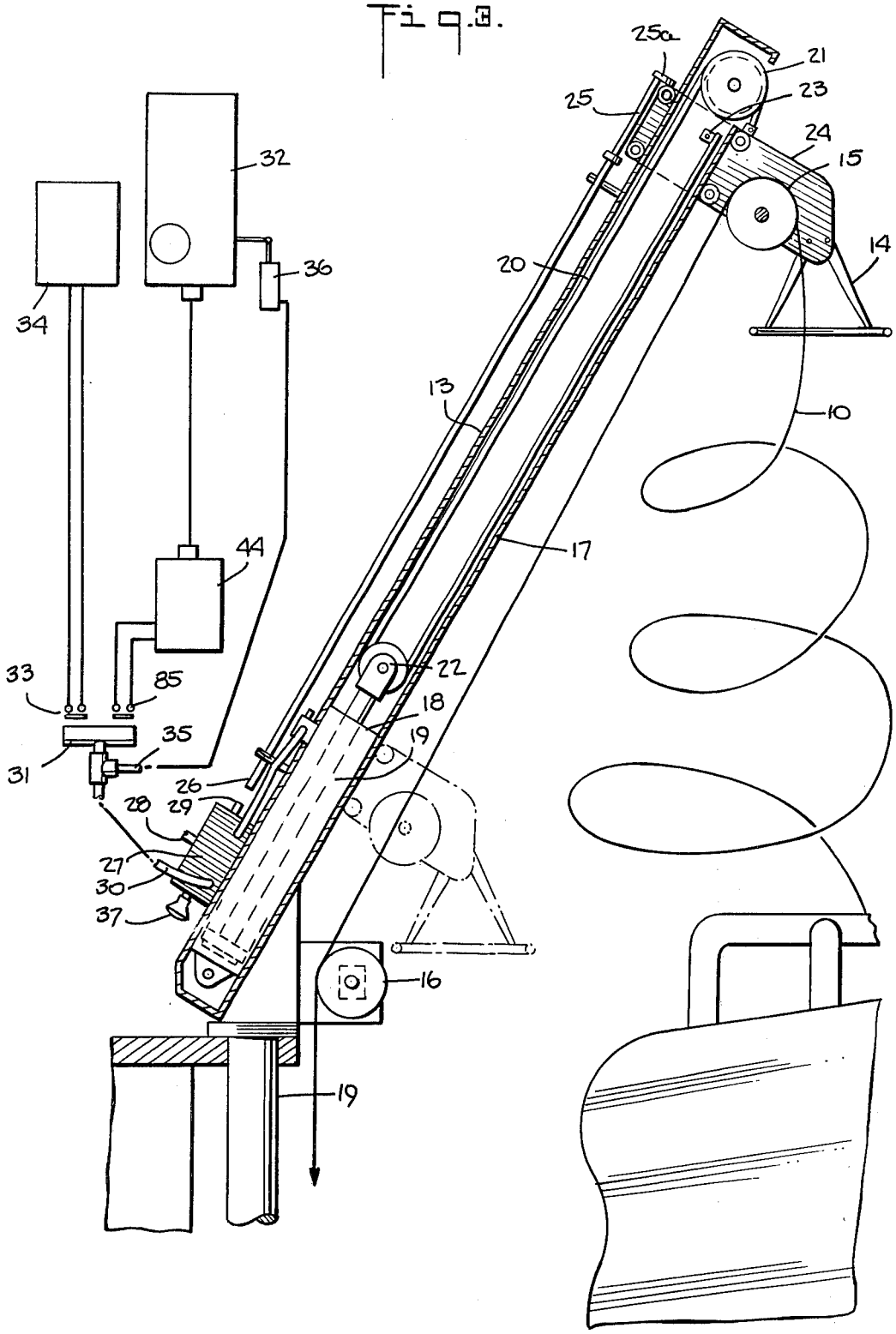
FIG. 3 is a partial cross sectional view of the feeding boom of my invention, also illustrating a portion of the pneumatic and electrical control system of my invention.

Boom 13, as shown in FIG. 3, is formed from an outer casing 17, and an internal, pneumatic control cylinder 18 which has within it a piston 19 used to control the position of feed guide 14. Feed guide 14 is connected to frame 24 which is mounted by ball bearings to the exterior of the outer casing 17 of boom 13 and rides up and down the casing 17. Frame 24 is is connected by a chain or flexible cable 20, over pulleys 21 and 22 to the side of casing 17 at point 23. Pulley 22 is in turn connected to the piston 19 within the pneumatic control cylinder 18. Frame 24, when in its extended feeding position, engages one end of rod 25 through flange 25*a*. The other end 26 of rod 25, is in juxtaposition to a four way air control valve 27. This valve 27 is in turn connected to an air supply through line 28 and valve 27 and in normal operation causes piston 19 to be extended as shown in FIG. 3. This in turn forces frame 24 and feed guide 14 to the operating, feeding position at the upper end of boom 13. If, however, a snag should develop in the feeding of rod 10, for example, at feed guide 14, under the sudden tension of rod 10 caused by the snag and the continual pull of the rod by the drawing bench through the machine, frame 15 is retracted slightly down boom 13. This causes rod 25 to move down boom 13 under gravity or spring control, with its end 26 striking the control rod 29 of air valve 27. This movement of control rod 29 in air valve 27 causes the air pressure within cylinder 18 to be released, retracting piston 19 and moving it up boom 13. The retraction of piston 19, permits feed guide 14, and frame 24 to move down boom 13 under the control of cable 20. After the complete release of the air pressure in cylinder 18, the feed guide 14 and frame 24 are moved down to the position shown in dashed lines in FIG. 3 where the operator may remove the snag, weld a broken rod or take what ever remedial action is required.

In the event a snag is encountered, it is not only desirable to be able to correct the snag but also to be able to shut down the machine to avoid breaking the rod within the machine or in the drawing bench. Thus, air valve 27 is connected by line 30 to air pressure switch 31. This switch 31 is normally closed but upon the movement of rod 29, the air pressure within valve 27 causes switch 31 to open thereby disconnecting the electrical supply to the draw bench 32 through switch 33 and draw bench control 34. Further, if desired, air line 30 can be connected through the junction 35 to operate a pneumatic declutch mechanism 36 on draw bench 32.

After the snag has been corrected, frame 24 and feed guide 14 are returned to their operating position by the machine operator manually depressing knob 37. This introduces air pressure into the control cylinder 18 and returns piston 19 to the lower portion of cylinder 18, causing frame 24, pulley 15 and guide 14 to be returned to the upper feeding position shown in FIG. 3.

Figure 4:
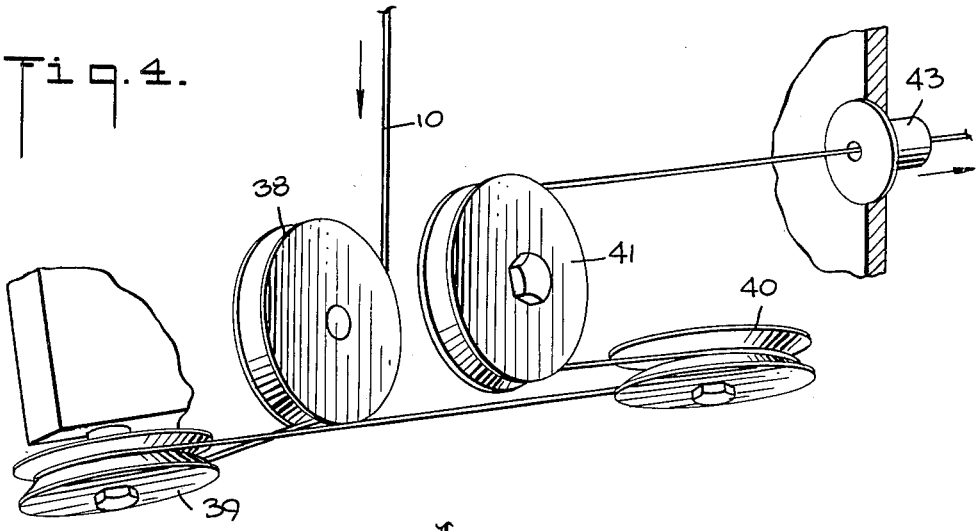
FIG. 4 is a partial perspective view of the descaling rollers employed in my invention.
Figure 5:
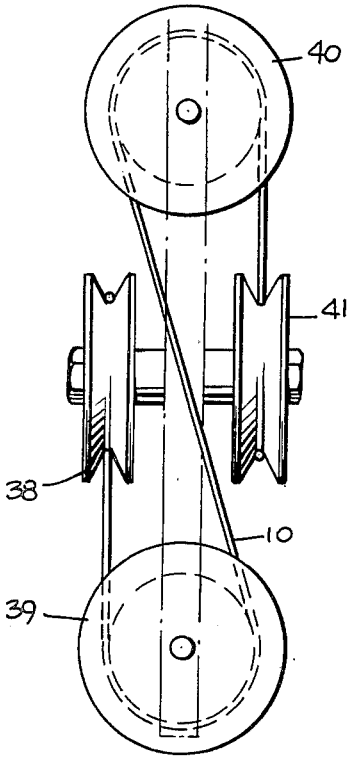
FIG. 5 is a top plan view of the descaling rollers employed in my invention.

Rod 10, after passing ver pulley 16, passes over breaker or descaling rollers 38, 39, 40 and 41, (FIG. 4), located within housings 42. (FIG. 1) The rollers are mounted on axles and rotate as the rod passes over them. They also are arranged in two vertical and one horizontal planes to flex the rod in at least four directions as it passes over the rollers. As seen in FIGS. 4 and 5, the rod 10 first passes over the vertical roller 38 where it is turned through a 90° angle. Because the scale on the outer surface of the rod is brittle and not as flexible as the rod, the flexing demanded of the rod as it passes over roller 38 and moves through the 90° angle causes the scale on the outer surface of rod 10 to be loosened or broken away. It should be noted that housing 42 is adapted to permit the feeding of rod onto roller 38 from either a vertical direction, as shown in FIGS. 4 and 5 or in a horizontal direction in a 180° bend around roller 38.

After roller 38, the rod 10 is forced to bend 180° in the horizontal direction as it is passed over horizontal roller 39. From roller 39, rod 10 advances over horizontal roller 40 where it again bends through a 180° angle. A final 180° bend is put on rod 10 as it passes over vertical roller 41. Thus the outer surface of the rod is effectively bent at least once in each of the four quadrants of the suface area of the rod. This flexing loosens or removes a majority of the scale on the outer surface of the rod.

From the scale breaker roller 41 the rod 10 is passed through bushing 43 in cleaning unit 44. This cleaning unit 44 scours the outer surface of the rod 10, thereby cleaning any residual scale remaining on the rod and preparing the rod for coating.

Cleaning unit 44 has a drive mechanism comprised of two pulleys 45 and 46, stationary gear 47, planetary gears 48 and 49, belt 50 and electric motor 51. In operation, motor 51, through belt 50, rotates pulley 45. Housings 52 and 53 are removably connected to pulleys 45 and 46 by removable shafts 52*a* and 53*a*. Suitable bearings and bushings are used between the pulley housings and shafts so that the driving of pulley 45 through housings 52 and 53 and rods 52*a* and 53*a* causes planetary gears 48 and 49 to rotate abot rods 52*a* and 53*a* respectively and to orbit around the stationary gear 47.

Removably fastened to housings 52 and 53 are drums 54 and 55, which are comprised of two end plates 57 and 58 and two resilient outer sleeves 56, which may be made from rubber or other suitable resilient material. These sleeves 56 are mounted on the two end plates 57 and 58, which have an internal opening to receive housings 52 and 53. After assembly, air pressure is introduced within the drums 54 and 55 through valve 59.

Figure 2:
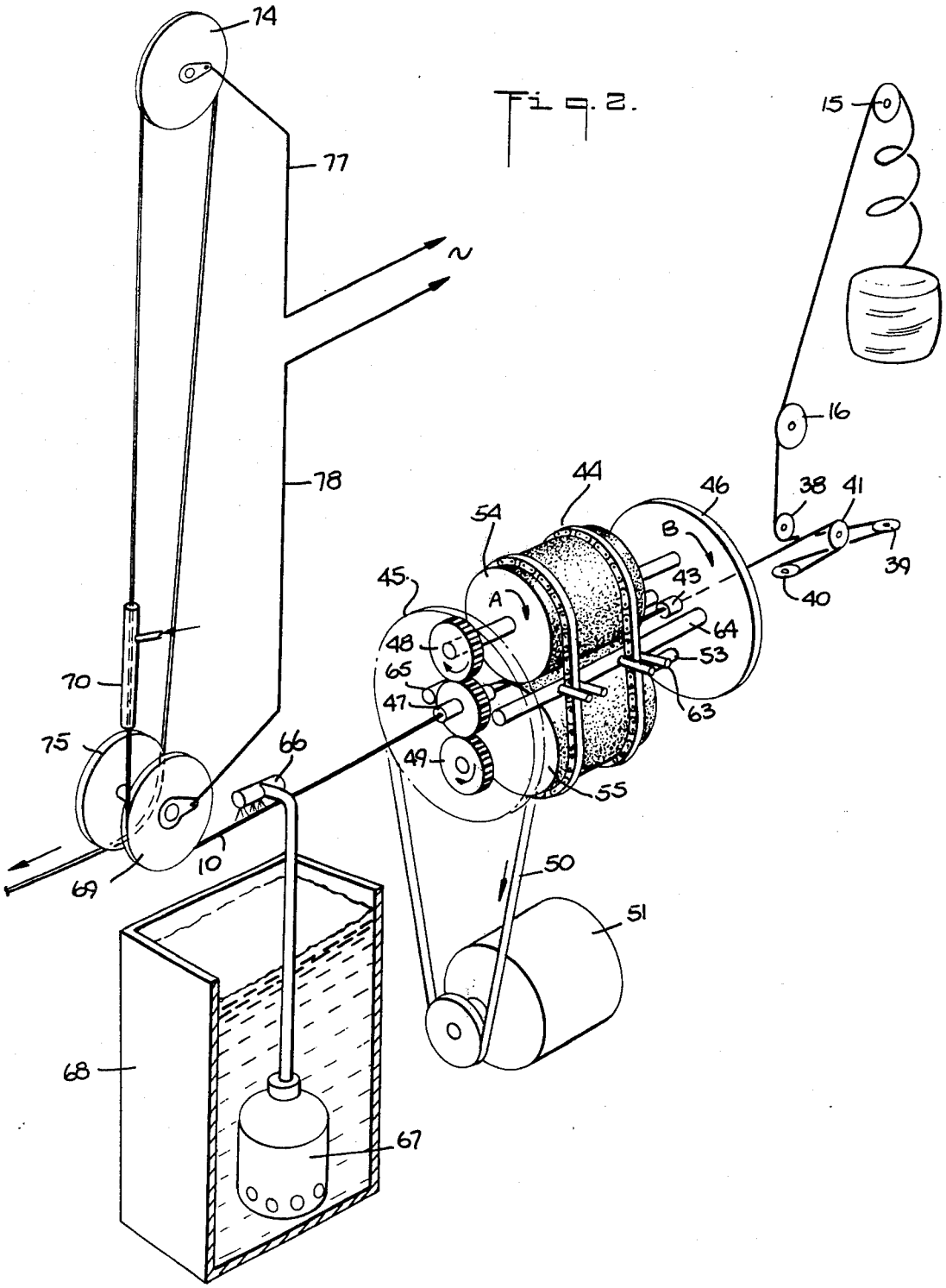
FIG. 2 is a schematic view of the machine illustrating the progression of the rod through the machine and the various process steps carried out on the rod.
Figure 6:
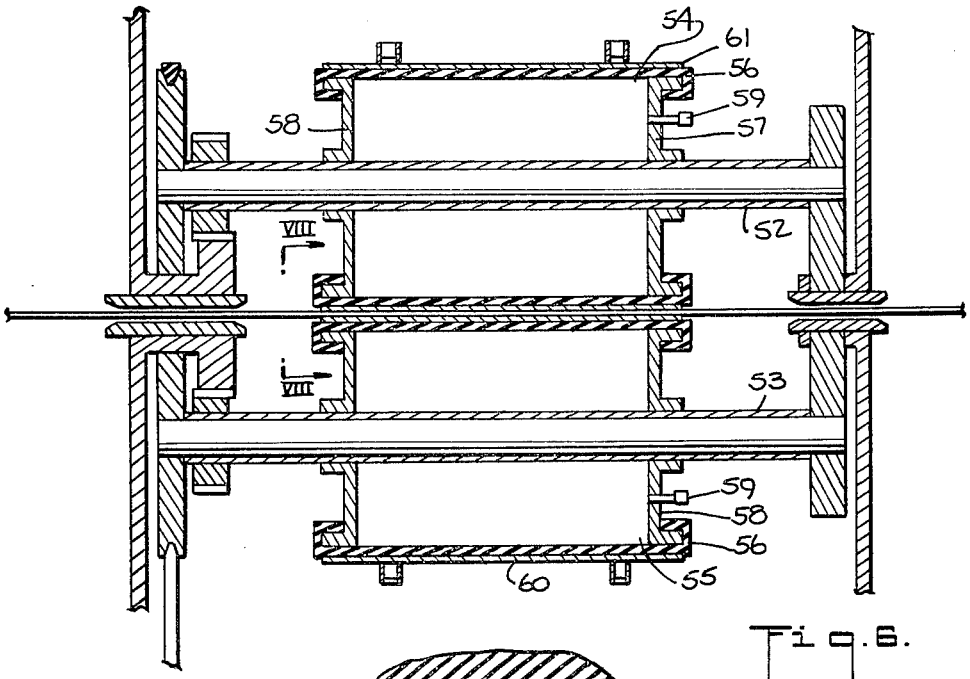
FIG. 6 is a cross sectional view of the rotating, resilient abrasive means used in my invention.

Mounted on the outer surface of sleeve 56 is an abrasive belt 60. As shown in FIGS. 2 and 6, the driving of pulley 45 through the arrangement of rods 52 and 53, and gears 47, 48 and 49, causes abrasive belts 60 and 61 to scrape the entire outer surface of rod 10 as it is passed through cleaning unit 44. The entire outer surface is scraped and cleaned because the drums 54 and 55 revolve about rods 52 and 53 (as indicated by arrow A in FIG. 2) as well as orbit about stationary gear 47 (as indicated by arrow B in FIG. 3). Thus the entire outer surface of the rod 10 is scraped and polished by abrasive belts 60 and 61. This scraping, while removing any residual scale remaining after passage through the breaker or descaling rollers 38, 39, 40 and 41, also produces a cleaned roughened surface highly suitable for the application of a solution of lime or borax to it.

Figure 7:
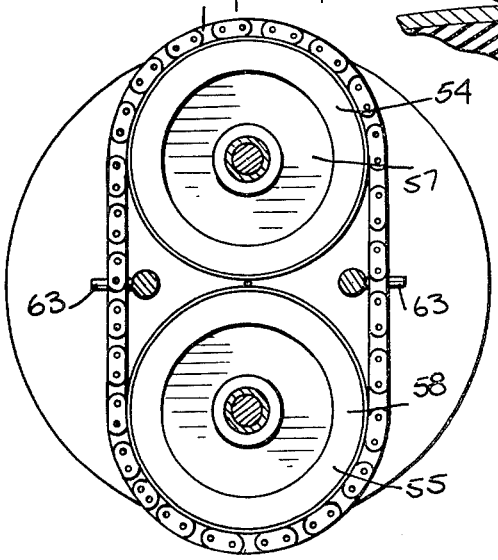
FIG. 7 is a front plan view of the resilient abrasive means at rest.
Figure 9:
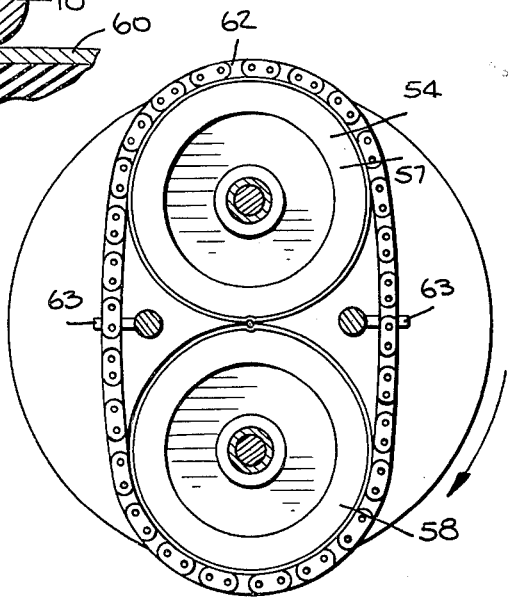
FIG. 9 is a front plan view of the resilient abrasive means during operation of the machine.

In order to properly control the cleaning of rod 10, compression control means are utilized for the drums 54 and 55. As seen in FIGS. 2, 7 and 9, retaining means 62, are wrapped around the drums 54 and 55. These retaining means, while shown as chains in the FIGS,, can also be belts or other suitable devices. The lateral movement of chains 62 is prevented by guides 63 mounted to rods 64 and 65.

Figure 8:
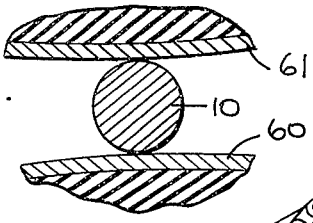
FIG. 8 is a partial cross sectional view taken along lines VIII—VIII of FIG. 6, showing the resilient abrasive means and the rod passing through the abrasive means when the abrasive unit is at rest.
Figure 10:
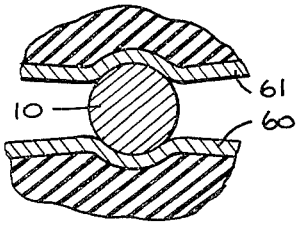
FIG. 10 is a partial cross sectional view taken along lines VIII—VIII of FIG. 6 showing the resilient abrasive means and the rod passing therethrough during operation of the machine.

When cleaning unit 44 is at rest, as shown in FIG. 7, the chain 62 lies slack. However, in operation, because of the orbital rotation of the drums 54 and 55 about gear 47 and the rotation of the drums 54 and 55 about gears 48 and 49, the chains 62 have a tendency to "sling out" as shown in FIG. 9. Because the length of the chains is fixed, this outward movement causes compression of the drums by the chains in the area where the chains tangentially contact the drums 54 and 55. This is shown in FIG. 9. This compression of the drums is used to prevent high spots from occurring on rod 10 if it has any bends or physical variations on its outer surface as it passes through the cleaning unit. Thus when the drums are not rotating they rest against the surface of the rod 10 as shown in FIG. 8. But because of the restraining force of the chains 62, and the resilient nature of the drums 54 and 55, a frictional force is applied to the rod in the manner shown in FIG. 10 during the operation of the cleaning unit. Thus any physical deformation of the rod 10 does not impair its cleaning.

Figure 11:
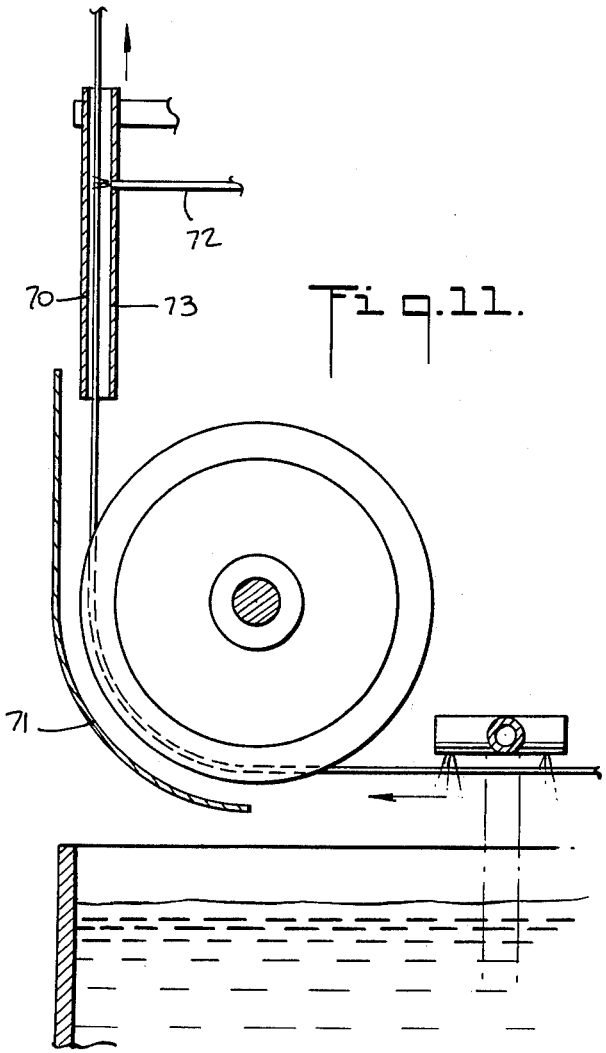
FIG. 11 is a partial cross sectional view of the coating means of my invention.

After passage through cleaning unit 44, the rod is now in condition for coating. As shown in FIG. 2, the rod passes under spigot 66 where a solution of borax or lime flows on to the surface of the rod 10. The solution is pumped by submersible pump 67 from reservoir 68 through pipe 76 and out spigot 66. The wetted rod 10 is then passed over pulley 69 and through air knife 70. A baffle 71 is placed on the outside of pulley 69 in order to direct any excess solution or spray back into reservoir 68. Air knife 70, as shown in FIG. 11, operates by passing a constant air stream from air line 72 over the solution coated, advancing rod. This air stream, directed on the rod within the tubular housing 73, acts to remove any excess solution and to insure that all portions of the rod 10 are covered.

Because it is preferable for the borax or lime coating on rod 10 to be dried when the lubricant is applied, as explained in my earlier U.S. Pat. No. 3,641,970, I provide for the internal conduction of an electric current through the rod 10 as it passes upward from pulley 69 to pulley 74 and back down from pulley 74 to pulley 75. This electric current is obtained by applying an electric potential between pulley 74 and pulleys 69 and 75 as shown in FIG. 2 by conductors 77 and 78. Because both pulleys 69 and 75 are grounded and pulley 74 is electrically isolated from ground, a low voltage potential can generate a current flow within rod 10 as it passes up from pulley 69 to pulley 74 and back to pulley 75. Here if sufficient power is present, a low voltage, high amperage current is conducted through rod 10. Because of the electrical resistance of the rod, this high amperage acts to heat the rod; the heat in turn acts to evaporate the water from the lime solution and to bake a coating of the material on the rod.

Thus the rod passing over pulley 75 has been descaled, cleaned, and coated with a baked lime or borax coating and progresses to the drawing step at a relatively elevated temperature, readily adapted to receive lubricant.

It should be understood that the coating solution used in my invention while described as a lime or borax solution may be any solution which is capable of being baked on to the outer surface of the rod and which can act as a carrier for the lubricant in the drawing process. Further, it is within the scope of my invention to combine the carrier and lubricant in the coating solution applied to the cleaned rod and bake the combined carrier and lubricant coating on to the outer surface of the rod in accordance with my invention.

Figure 12:
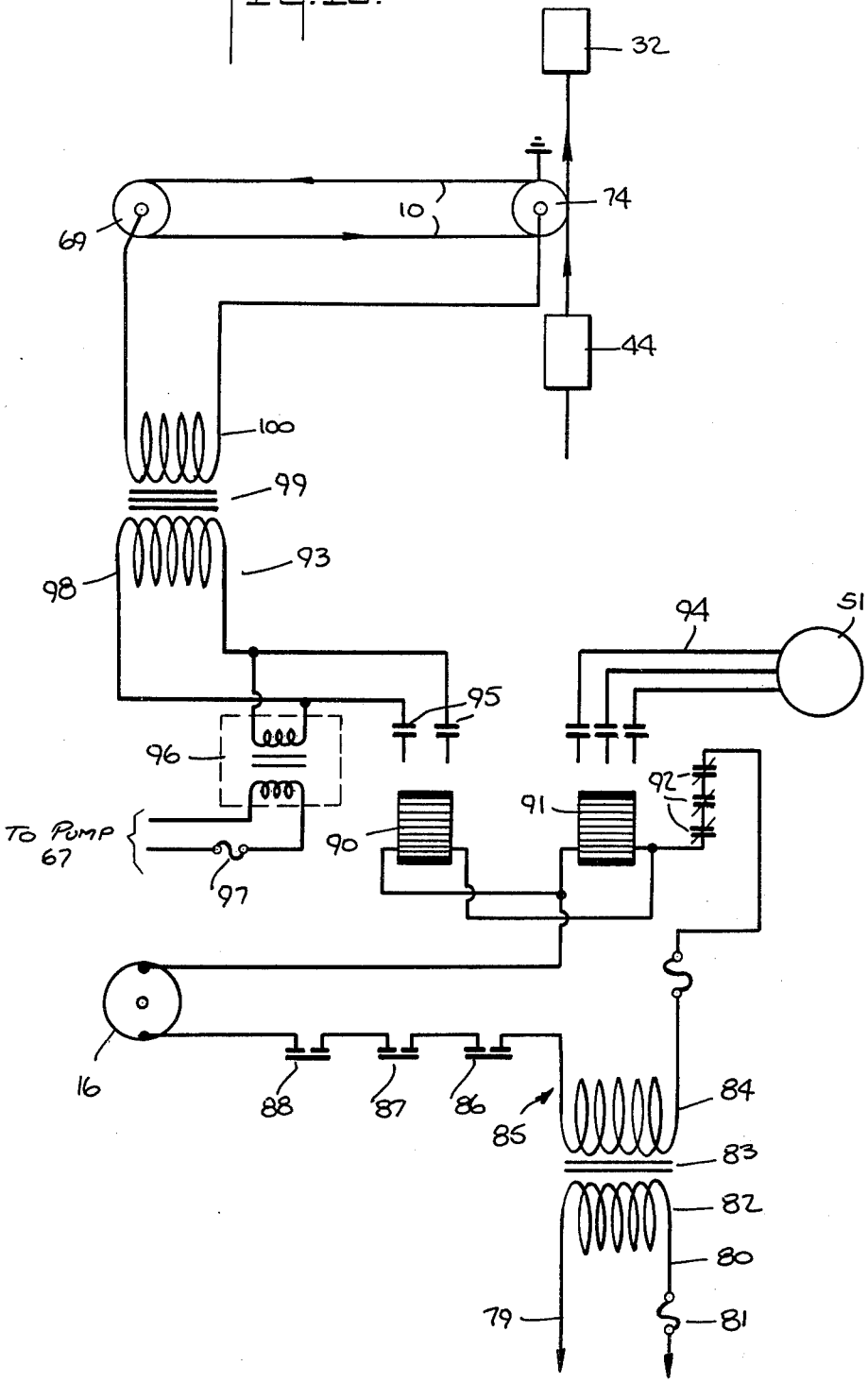
FIG. 12 is a schematic view of the electrical supply and control system of my invention.

In order to properly operate my apparatus and method, I have also invented an electrical power supply and control system which is schematically illustrated in FIG. 12, which shows a power source, connected through lines 79 and 80, having a fuse 81, and connected to the primary 82 of a control transformer 83. From the secondary 84 of the control transformer 83, conductor 85, is serially connected with the electrical contacts of snarl switch 86, which as shown in FIG. 3, and as explained above, is opened if a snarl is developed in the feeding of rod 10 to the machine. Switches 87 and 88 are safety switches located on the access doors or other removable parts of the machine. Switch 16 in FIG. 12 is the centrifugal control switch shown in FIG. 3. This switch opens when the rod stops and closes when the rod moves. Thus if the rod should stop for any reason, the power to the machine is disconnected and the machine stopped. From switch 16, conductor 89 connects two coils 90 and 91 in parallel. The circuit is then connected through thermal overload switches 92 back to the secondary 84 of transformer 83. Thus, if all switches 86, 87, 88 and 16 are closed, power is supplied through coils 90 and 91 to the heating circuit 93 and to the drive circuit 94.

Heating circuit 93, has apair of contacts 95 which, upon the energizing of coil 90, close, energizing the pump transformer 96, which through fuse 97 supplies the pump 67 in reservoir 68.

Also connected to the coil 90 is the primary 98 of heating transformer 99, the secondary 100 of which supplies the power to pulleys 69, 74, and 75, between which the wire 10 conducts current completing the circuit.

In the foregoing, the invention has been described in reference to specific exemplary embodiments. It will be evident, however, that variations and modifications, as well as the substitution of equivalent constructions and arrangements for those shown for illustration, may be made without departing from the broader scope and spirit of the invention as set forth in the appended claims. The specification and drawings are accordingly to be regarded in an illustrative rather than in a restrictive sense.

What is claimed is:

1. A method for preparing rod for drawing, the rod having brittle scale and other impurities on its outer surface comprising the steps of continuously feeding a supply of rod from a rod source, through a cleaning unit, scraping the exterior surface of the rod in the cleaning unit by the frictional engagement of the rod passing between the two abrasively coated resilient drum members disposed substantially opposite each other, each of said drum members rotating about its own axis, each of said drum members positively compressed against said rod when said members rotate, and also orbiting about an axis, substantially corresponding to the mid point of the rod, whereby the entire outer surface of the rod is cleaned.

2. A method for preparing rod for drawing as in claim 1 further comprising the step of mechanically descaling at least a portion of the scale on the outer surface of the rod by bending the rod through a plurality of angles before passing the rod through the cleaning unit.

3. A method for preparing rod for drawing as in claim 2 further comprising the steps of spraying a solution of coating material upon the exterior of the rod, after the rod has been cleaned, removing the excess amount of the coating solution from the exterior of the rod by directing a gas stream at substantially right angles to said rod, electrically heating the surface of the coated rod to bake the coating on the exterior of the rod, and passing the coated rod with the baked outer coating thereon to the drawing device.

4. A method for preparing rod for drawing as in claim 3 in which the step of mechanically descaling the rod comprises passing the rod through at least three 180° bends and at least one 90° bend, each of said bends so disposed relative to each other such that the rod is bent, at least once, in each of the four quadrants of the surface area of the rod.

* * * * *